United States Patent [19]

Sohn

[11] 4,439,709

[45] Mar. 27, 1984

[54] COLOR PICTURE TUBE HAVING IMPROVED TEMPERATURE COMPENSATING SUPPORT FOR A MASK-FRAME ASSEMBLY

[75] Inventor: Frank M. Sohn, Leola, Pa.

[73] Assignee: RCA Corporation, New York, N.Y.

[21] Appl. No.: 373,050

[22] Filed: Apr. 29, 1982

[51] Int. Cl.[3] ..... H01J 29/07

[52] U.S. Cl. ..... 313/406; 313/407

[58] Field of Search ..... 313/406, 407, 404

[56] References Cited

U.S. PATENT DOCUMENTS

| | | | |
|---|---|---|---|
| 2,795,718 | 6/1957 | van Hekken et al. | 313/404 |
| 2,795,719 | 6/1957 | Morrell | 313/404 |
| 3,370,194 | 2/1968 | Schwartz et al. | 313/404 |
| 3,487,251 | 12/1969 | Barten et al. | 313/406 |
| 3,492,522 | 1/1970 | Pappadis | 313/406 |
| 3,529,199 | 9/1970 | Duistermaat et al. | 313/404 |
| 3,803,436 | 4/1974 | Morrell | 313/406 X |
| 3,832,592 | 8/1974 | Yamazaki | 313/404 |
| 3,943,399 | 3/1976 | Sedivy | 313/404 |

*Primary Examiner*—Palmer C. Demeo

*Attorney, Agent, or Firm*—Eugene M. Whitacre; Dennis H. Irlbeck

[57] ABSTRACT

An improved color picture tube includes an evacuated envelope enclosing a mask attached to a frame, which is suspended in relation to a cathodoluminescent screen by novel support means. The tube also includes an electron gun for forming a plurality of electron beams and directing the beams through the mask to the screen. The novel support means includes a plurality of studs embedded in the envelope and a plurality of spring assemblies spaced around the frame. Each spring assembly comprises a first spring and a second spring, each spring including a central portion, two flexible portions extending from the ends of the central portion and two end portions extending from the flexible portions. The end portions of the first spring are attached to the end portions of the second spring. The central portion of the first spring is attached to the frame and the central portion of the second spring includes an aperture which is in engagement with one of the studs. The flexible portions of both springs are of rhomboid-shape and offset the central portion of the second spring from the central portion of the first spring in the direction of the longitudinal axis of the tube away from the screen. When the mask and frame expand during tube operation, the flexible portions bend to permit the central portions of the first springs to move toward the central portions of the second springs, thereby moving the mask and frame relative to the screen.

2 Claims, 6 Drawing Figures

COLOR PICTURE TUBE HAVING IMPROVED TEMPERATURE COMPENSATING SUPPORT FOR A MASK-FRAME ASSEMBLY

BACKGROUND OF THE INVENTION

This invention relates to color picture tubes of the type having a mask attached to a frame which is suspended in relation to a cathodoluminescent screen, and particularly to a temperature compensating support for suspending the mask-frame assembly within the tube.

In these color picture tubes, the accuracy with which the electron beams strike the individual elemental cathodoluminescent screen areas depends, to a great extent, upon the accuracy with which the mask apertures are aligned with the elemental screen areas during operation of the tube. Thus, as the mask expands by reason of thermal effects occasioned by the impact thereon of the electron beams, the resulting misalignment of the mask apertures and elemental screen areas causes a portion of the electron beams to impinge upon elemental screen areas other than the ones upon which they were intended to impinge.

Several methods or means have been proposed to compensate for thermal expansion of the mask by causing the mask to move toward the screen as it expands outwardly, to maintain the desired alignment of the mask apertures and elemental screen areas. One early approach disclosed in U.S. Pat. No. 2,795,719, issued to Morrell on June 11, 1957, proposed moveably mounting the mask within the envelope by means of three carriages attached to the periphery of the mask and sliding on inclined tracks mounted on the envelope. Another early approach disclosed in U.S. Pat. No. 2,795,718, issued to van Hekken et al. on June 11, 1957, proposed the use of a multiplicity of flexible hinges connecting the masking member with a supporting frame, or a pivoted bell crank having arms slidably engaging the mask. These compensating means were designed primarily for use with circular masks in round tubes of moderate size and moderate deflection angle.

Most present day color picture tubes utilize a bimetallic mask mounting assembly such as described in U.S. Pat. No. 3,803,436, issued to Morrell on Apr. 9, 1974. In this patent, a bimetallic element is connected between a stud embedded in the faceplate panel and the mask electrode. The bimetallic element may be a spring welded directly to the frame or an intermediate member located between the spring and frame.

Although the bimetallic elements have served well for their intended purpose, their additional cost is relatively high. Therefore, there is a need for further development of thermal compensating mask supports which do not utilize bimetallic elements and which are not mechanically complex.

SUMMARY OF THE INVENTION

An improved color picture tube according to the invention includes an evacuated envelope enclosing a mask attached to a frame which is suspended in relation to a cathodoluminescent screen by novel support means. The tube also includes an electron gun for forming a plurality of electron beams and directing the beams through the mask to the screen. An axis passing through the center of the electron gun and the center of the screen is defined as the longitudinal axis of the tube. The novel support means includes a plurality of studs embedded in the envelope and a plurality of spring assemblies spaced around the frame. Each spring assembly comprises a first spring and a second spring, each spring including a central portion, two flexible portions extending from the ends of the central portion, and two end portions extending from the flexible portions. The end portions of the first spring are attached to the end portions of the second spring. The central portion of the first spring is attached to the frame, and the central portion of the second spring includes an aperture which is in engagement with one of the studs. The flexible portions of both springs are of rhomboid-shape and offset the central portion of the second spring from the central portion of the first spring in the direction of the longitudinal axis away from the screen.

With the foregoing construction, when the mask and frame expand during tube operation, the flexible portions bend to permit the central portions of the first springs of the spring assemblies to move toward the central portions of the second springs, thereby moving the mask and frame relative to the screen.

DETAILED DESCRIPTION

Figure 1:
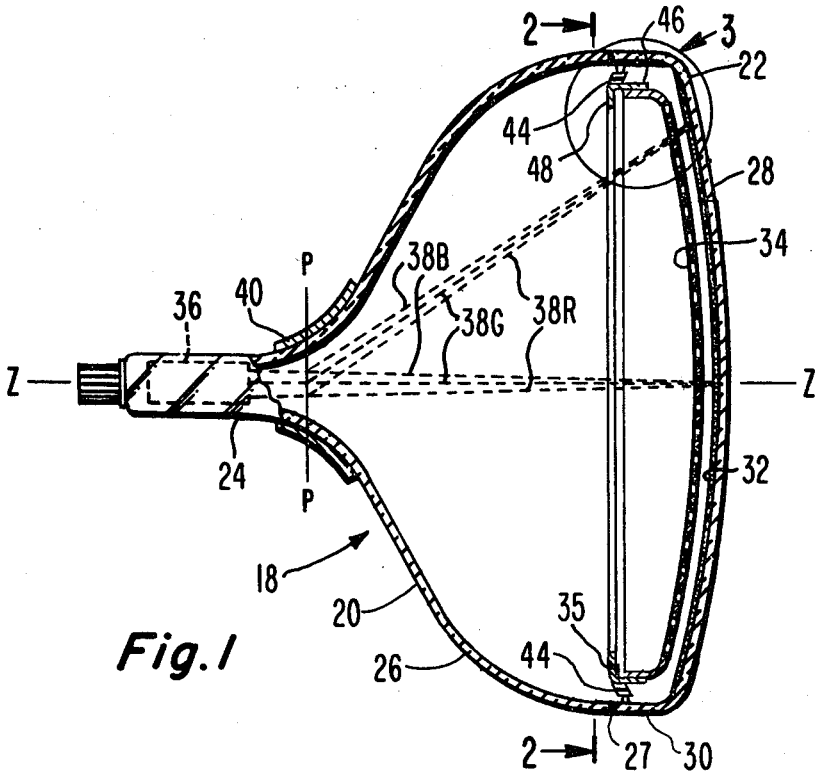
FIG. 1 is a plan view in axial section of an apertured mask cathode-ray tube.

FIG. 1 illustrates a rectangular color picture tube 18 having an evacuated glass envelope 20 comprising a faceplate panel 22 and a tubular neck 24 joined by a funnel 26. The panel 22 comprises a viewing faceplate 28 and a peripheral flange or sidewall 30 which is sealed to the funnel 26 by a frit material 27. A mosaic three-color cathodoluminescent line screen 32 is located on the inner surface of the faceplate 28. The screen 32 comprises an array of phosphor lines extending substantially parallel to the vertical axis of the tube. Portions of the screen 32 may be covered with a light absorbing material in a manner known in the art. A multiapertured color selection electrode or shadow mask 34, attached to a frame 35 having an L-shaped cross section, is removeably mounted within the panel 22 in predetermined space relationship to the screen 32. A novel support for this mask-frame assembly is described in detail below. The mask 34 includes a multiplicity of slit-shaped apertures, which are aligned in substantially parallel vertical columns, and web portions separating the slits of each column. An inline electron gun 36 (illustrated schematically) is mounted within the neck 24 to generate and direct three electron beams 38B, 38R and 38G along coplanar convergent paths through the mask 34 to the screen 32.

The tube 18 is designed to be used with an external magnetic deflection yoke 40 surrounding the neck 24 and funnel 26 in the vicinity of their junction. When appropriate voltages are applied to the yoke 40, the three beams 38B, 38R and 38G are subjected to vertical and horizontal magnetic fields that cause the beams to scan horizontally and vertically in a rectangular raster over the screen 32. For simplicity, the actual curvature of the paths of the deflected beams in the deflection zone is not shown in FIG. 1. Instead, the beams are schematically shown as having an instantaneous bend at the plane of deflection P—P.

Figure 2:
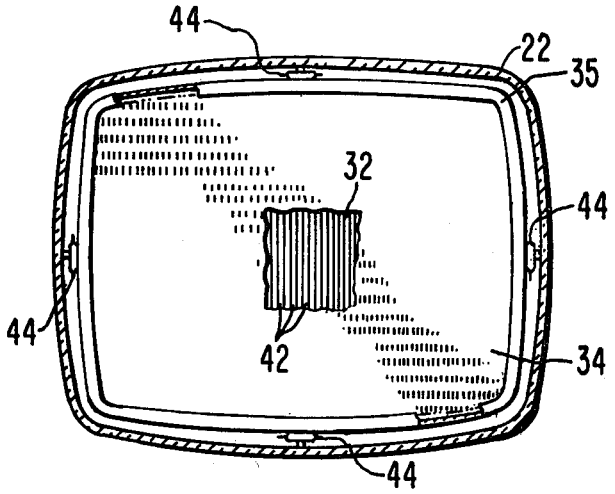
FIG. 2 is a back view of the faceplate and mask-frame assembly of the tube of FIG. 1.

A portion of the screen 32, partially covered by the mask 34, is illustrated in FIG. 2. The screen 32 comprises alternate lines 42 of red, green and blue-emitting phosphor elements. Also shown in FIG. 2 are four mask-frame supports 44 (two of which are shown in FIG. 1) that suspend the assembly of the mask 34 and frame 35 within the panel 22. FIGS. 3 through 6 show the mask-frame supports 44 and associated portion of the frame 35 in greater detail.

Figure 4:
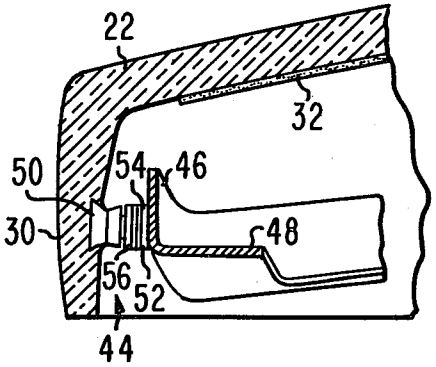
FIGS. 3 and 4 are enlarged views of the critical portion, designated 3, of the tube of FIG. 1 without a shadow mask, when the frame is cool and when the frame is hot, respectively.
Figure 3:
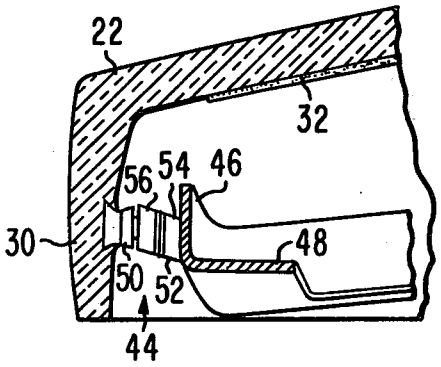
Figure 6:
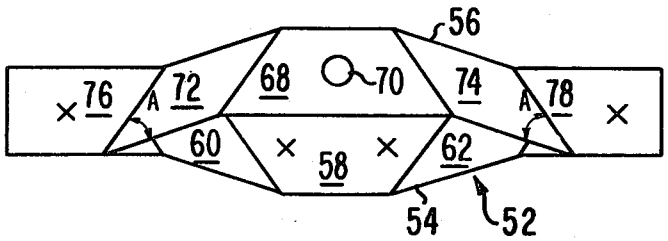
FIGS. 5 and 6 are top and side views, respectively, of a novel spring assembly in accordance with the invention.
Figure 5:
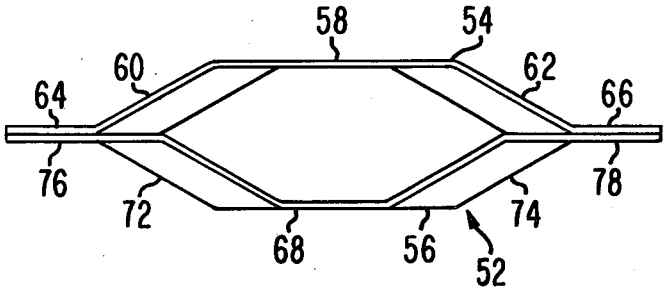

The frame 35 has an L-shaped cross section with a first flange 46 extending toward the screen 32 and a second flange 48 extending toward the longitudinal axis Z—Z of the tube 18, as shown in FIGS. 3 and 4. Each mask-frame support 44 includes two components; a stud 50 embedded into the sidewall 30 of the panel 22, and a spring assembly 52. Each spring assembly 52 comprises a first spring 54 and a second spring 56, shown in detail in FIGS. 5 and 6. The first spring 54 includes a central portion 58 which is welded to the first flange 46 of the frame 35, two rhomboid-shaped flexible portions 60 and 62 that extend from the ends of the central portion 58 and two end portions 64 and 66 that extend from the ends of the flexible portions 60 and 62, respectively. The second spring 56 includes a central portion 68 that has an aperture 70 therein which is in engagement with a stud 50. Two rhomboid-shaped flexible portions 72 and 74 extend from the ends of the central portion 68. Two end portions 76 and 78 extend from the ends of the flexible portions 72 and 74, respectively. The end portions 76 and 78 of the second spring 56 are welded to the end portions 64 and 66, respectively, of the first spring 54. The rhomboid-shaped flexible portions 60 and 62 of the first spring 54 and the rhomboid-shaped flexible portions 72 and 74 of the second spring 56 offset the central portion 68 of the second spring 56 from the central portion 58 of the first spring 54 in the direction of the longitudinal axis Z—Z away from the screen 32.

In the preferred embodiment, four spring assemblies 52 are positioned on the vertical and horizontal axes of the tube panel 22 with the spring assemblies 52 on opposite sides of the tube being directly opposite each other. This ensures that the resultant forces applied to the frame 35 by the spring assemblies 52 will be balanced.

During operation of the tube 18, the mask 34 and frame 35 are struck by the electron beams emitted from the electron gun 36 and are heated thereby. This heating results in expansions of both the mask 34 and frame 35. The expansion of the frame 35 exerts a force on the spring assemblies 52, causing them to collapse. In effect, the central portions 58 of the first springs 54 move toward the central portions 68 of the second springs 56. This collapsing movement results in movements of the mask 34 and of the frame 35, to which the first spring central portions 58 are attached, toward the screen 32.

The amount of mask movement effected by the spring assemblies 52 is dependent on the oblique angles in the rhomboid-shaped flexible portions 60, 62, 72 and 74. Greater mask movement is obtained by decreasing the acute angle (designated angle A in FIG. 6) of the flexible portions. The acute angle required is dependent on the amount of mask movement required to maintain electron beam register for a particular tube. Because of the many variables in tubes, such as different mask and frame materials, different internal components attached to the mask and different mask radiation characteristics, some experimentation is required to obtain the proper angles for a particular tube. In one 21 V tube, the spring assemblies 52 were constructed of S44S11 0.734 mm thick stainless steel and the acute angles of the flexible portions was 30 degrees. In another embodiment constructed of S44S11 0.381 mm thick stainless steel the acute angle was 45 degrees.

Although the preferred embodiment is described herein with respect to a line-screen, slit-aperture-mask type color picture tube, the invention also is applicable to other types of color picture tubes such as dot-screen, circular-aperture type tubes or tubes having other type screens combined with other type mask electrodes.

It should also be understood that the novel mask-frame supports may be used with a tube wherein the frame is an integral portion of the mask, such as may be obtained by suitable bending of the mask skirt to form a peripheral reinforcing frame. Furthermore, although the novel support embodiment described herein will cause the mask to be moved toward the screen when the support is heated, the support can be used to move the mask away from the screen as the support is heated by inverting the orientation of the spring assemblies.

What is claimed is:

1. In a color picture tube of the type including an evacuated envelope enclosing a cathodoluminescent screen, an electron gun and an apertured mask attached to a frame which is suspended in relation to said screen by support means, an axis passing through the center of said electron gun and the center of said screen being the longitudinal axis of said tube, the improvement comprising said support means including a plurality of studs embedded in said envelope and said frame, and a plurality of spring assemblies spaced around and attached to said frame, each spring assembly comprising a first spring and a second spring, said first and second springs each including a central portion, two flexible portions extending from the ends of said central portion and two end portions extending from said flexible portions, the end portions of said first spring being attached to the end portions of said second spring, the central portion of said first spring being attached to said frame, the central portion of said second spring including an aperture in engagement with one of said studs, said flexible portions of said first and second springs being of rhomboid shape and offsetting the central portion of said second spring from the central portion of said first spring in the direction of said longitudinal axis away from said screen, whereby, when said mask and frame expand during tube operation, said flexible portions bend to permit the central portions of the first springs to move toward the central portions of the said second springs thereby moving said mask and frame relative to said screen.

2. The tube as defined in claim 1 including four of said spring assemblies, a spring assembly being at each side of said tube, and the spring assemblies on opposite sides of said tube being positioned directly opposite each other.

* * * * *